United States Patent [19]

Oostvogels et al.

[11] 4,233,542

[45] Nov. 11, 1980

[54] HIGH-PRESSURE DISCHARGE LAMP

[75] Inventors: Franciscus M. P. Oostvogels; Gustaaf Melis; Aime P. A. M. Van Laarhoven, all of Eindhoven, Netherlands

[73] Assignee: U.S. Philips Corporation, New York, N.Y.

[21] Appl. No.: 952,369

[22] Filed: Oct. 18, 1978

[30] Foreign Application Priority Data

Nov. 7, 1977 [NL] Netherlands ..... 7712215

[51] Int. Cl.[3] ..... H01J 7/44; H01J 13/46

[52] U.S. Cl. ..... 315/73; 315/74; 315/49; 313/17; H01J/19/78; H01J/23/16

[58] Field of Search ..... 315/73, 74, 75, 47; 313/17, 227, 49

[56] References Cited

U.S. PATENT DOCUMENTS

| | | | |
|---|---|---|---|
| 4,013,919 | 3/1977 | Corbley | 315/74 |
| 4,090,105 | 5/1978 | Koo | 315/74 |
| 4,143,301 | 3/1979 | Strauss et al. | 315/73 |

FOREIGN PATENT DOCUMENTS

| | | | |
|---|---|---|---|
| 267753 | 4/1970 | U.S.S.R. | 315/73 |

*Primary Examiner*—Saxfield Chatmon, Jr.
*Attorney, Agent, or Firm*—Robert S. Smith

[57] ABSTRACT

High-pressure discharge lamps, having a sealed discharge vessel surrounded by a sealed glass envelope, are known in which an oxidizable metal foil (e.g. of molybdenum) is located, in the space between the vessel and the envelope substantial on the axis of the vessel and is electrically in series with the discharge path. If the envelope is fractured for any reason and the lamp is subsequently ignited, the temperature of the foil is increased due to the discharge current passing through it. The foil is oxidized, and hence fractured, by the air which has permeated said space and the lamp is, extinguished. Such oxidation and fracture normally takes about ten minutes. In accordance with the invention, the foil (14) in the space between the envelope (1) and vessel (2) is arranged close to the wall of the vessel adjacent to an electrode (6) so as to be heated mainly by heat generated in the vessel. This reduces the fracturing time to about one minute.

2 Claims, 2 Drawing Figures

HIGH-PRESSURE DISCHARGE LAMP

Figure 1:
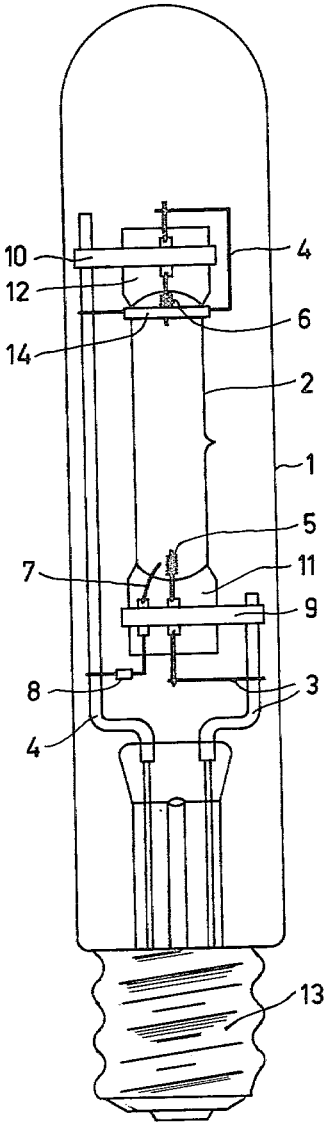

The invention relates to a high-pressure discharge lamp having a sealed vacuum-tight light-pervious lamp envelope within which a sealed vacuum-tight light-pervious discharge vessel is arranged, the space between them being evacuated or containing a non-oxidizing gas atmosphere, which vessel is provided with a respective electrode at each end, and an ionisable fill respective electrical current conductors extending through the wall of the lamp envelope and through the wall of the discharge vessel to the electrodes, an oxidation-sensitive metal foil which fractures on oxidation being accommodated between the two said walls in series with one of the current conductors.

Such a lamp is disclosed in British Pat. No. 1,051,948. The metal foil is positioned substantially on the axis of the discharge vessel between the discharge vessel and the base of the lamp. The object of the metal foil is to provide a safety device against explosion in case the lamp envelope should break and the lamp is started while the lamp is in an explosive atmosphere. The operation of the safety device is based on oxidation of the metal foil by penetrating air as a result of which the metal foil breaks and the lamp current circuit is interrupted.

However, in the case of fracture of the lamp envelope, at least part of which falling away the danger of damage to the skin and the eyes of human beings, or of damage to plants, may occur due to their consequent exposure to UV-radiation. In the aforesaid known lamp, which extinguishes in not more than 10 minutes when air has entered the lamp envelope, this danger is counteracted to an insufficient extent.

It is an object of the invention to provide high-pressure discharge lamps which extinguish within a comparatively short time after fracture of the lamp envelope, while the switching mechanism during operation of the lamp consumes only very little energy.

In agreement herewith the invention relates to a high-pressure gas discharge lamp of the kind mentioned in the preamble which is characterized in that the metal foil is situated adjacent an electrode and in the immediate proximity of the wall of the discharge vessel.

It has been found that lamps according to the invention, after fracture of the lamp envelope, extinguish more rapidly when the metal foil is situated nearer to the wall of the discharge vessel. In high-pressure mercury vapor discharge lamps without halide additions to the fill the foil is preferably in contact with the wall of the discharge vessel. In high-pressure mercury vapor discharge lamps having halide additions to the fill, contact of the foil with the wall of the discharge vessel may give rise to loss of alkali metal from the fill. In the last-mentioned lamps the foil is therefore generally arranged at some distance from the wall of the discharge vessel, however, preferably at a distance of not more than 2 mm, in particular not more than 1 mm.

An attractive feature of lamps according to the invention is that the safety device provides both speed and reliability. In order for the safety device to become operative, it is as a matter of fact not necessary for the lamp envelope to disappear entirely upon fracture or that fracture causes a predetermined part of the lamp envelope to disappear.

This is in contrast with mechanically-operated safety devices in which an electric contact is interrupted when a resilient contact finger no longer experiences any resistance from the wall of the lamp vessel, i.e. the safety device becomes operative only when fracture of the lamp envelope gives rise to the disappearance of at least that part of the lamp envelope against which the resilient contact finger bears.

If in lamps according to the invention fracture in the lamp envelope occurs, as a result of which air enters the lamp envelope, rapid oxidation of the foil takes place due to the high temperature (>500° C.) which the metal foil gains during operation of the lamp as a result of its positioning adjacent to the vessel; so that the foil fractures and the lamp extinguishes comparatively rapidly.

The metal foil may consist, for example, of molybdenum or iron. If a vacuum prevails in the lamp envelope or only a rare gas is present therein, for example, tantalum, zirconium or niobium may alternatively be used.

The metal foil derives its high temperature during operation mainly from the discharge vessel. Heat generation in the foil as a result of current passage therefore has only a comparatively small influence on the temperature of the foil. The advantage thereof is that the foil, which generally is chosen to be a few tens of microns thick, for example 30–50 μm, generally consumes less than 1% of the overall lamp power.

In cases in which an even more rapid reaction to the fracture of the lamp envelope is desired, foils may be used which are coated with a pyrophoric material, for example, pyrophoric iron powder.

It is to be noted that a high-pressure mercury discharge lamp is described in Product Engineering 46, July, 1975, pp. 12/13, in which a tungsten filament connected electrically in series with the gas discharge track is accommodated in the lamp envelope. The filament is situated at ample distance from the discharge vessel, near the elongation of the axis of the discharge vessel.

Although this lamp, upon fracture of the lamp envelope, would extinguish in 15 to 60 sec. as a result of the fusion of the tungsten filament, the filament causes an energy loss of $1\frac{1}{2}$ to 2% so long as the lamp is in operation. In comparison with lamps embodying the invention, this energy loss is 3 to 4 times as high, while the switching time is substantially the same.

Figure 2:
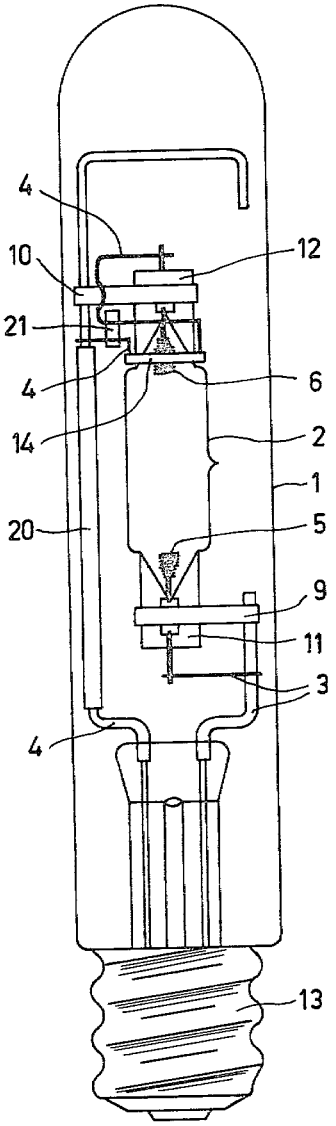

Embodiments of lamps according to the invention will now be described with reference to the accompanying drawing, of which FIG. 1 is an elevation of a high-pressure mercury vapour discharge lamp;

FIG. 2 is the elevation of a high-pressure mercury vapour discharge lamp with halide additions.

In FIG. 1, a sealed discharge vessel 2 is accommodated within a sealed lamp envelope 1. Current conductors 3 and 4 are passed in a vacuum-tight manner through the wall of the lamp envelope 1 and through the wall of the discharge vessel 2 and are connected to electrodes 5 and 6. An ignition electrode 7 is also connected to the current conductor 4 via a resistor 8. The discharge vessel 2 is suspended from the current conductors 3 and 4 by means of strips 9 and 10 surrounding pinches 11 and 12 of vessel 2. The lamp envelope 1 has a lamp cap 13. A molybdenum foil 14, which bears against the wall of the discharge vessel 2, is connected in series in the current conductor 4. In the lamp shown, which is a 400 W high-pressure mercury vapor discharge lamp, the foil has the dimensions $0.037 \times 10 \times 1$ mm and consumes approximately 2 W during operation. As a result of the current passage the temperature of the foil during operation increases to approximately 700° C.

Without current passage the foil would obtain a temperature of approximately 600° C. during operation. A vacuum prevails in the space between the wall of the lamp envelope and the wall of the discharge vessel.

If during operation of the lamp an opening occurs in the lamp envelope, e.g. by a fracture, which breaks the seal the molybdenum foil fractures within 30 seconds as a result of being oxidized by entering air.

In FIG. 2, corresponding parts are referred to by the same reference numerals as in FIG. 1.

In this case the discharge vessel comprises in addition alkalimetal halides. The current conductor 4 is partly surrounded by a ceramic sleeve 20. The oxidation-sensitive metal foil 14 is spaced less than 2 mm, for example approximately 1 mm, from the wall of the discharge vessel 2. The foil is provided in series between two parts of the current conductor 4 which are connected by a quartz glass beam 21 so as to obtain a more rigid construction.

The space between discharge vessel 2 and envelope 1 contains a mixture of nitrogen and argon. During operation the lamp consumes a power of approximately 400 W. The metal foil then has a temperature of approximately 650° C. In the case of fracture of the lamp envelope the foil will fracture after approximately 1 minute as a result of which the lamp extinguishes.

What is claimed is:

1. A high pressure discharge lamp which comprises: a sealed vacuum-tight light-pervious lamp envelope, a sealed vacuum-tight light-pervious elongated discharge vessel disposed in said envelope, the space between said envelope and said vessel being evacuated or containing a non-oxidizing gas atmosphere, said lamp further including first and second elongated electrodes disposed in spaced relation from each other within said vessel with the axis of each electrode and said vessel generally parallel, an ionizable fill disposed within said vessel, respective electrical current conductors extending through the wall of said lamp envelope and through the wall of said discharge vessel to said electrodes, and an oxidation-sensitive metal foil which fractures on oxidation connected electrically in series with one of the current conductors, said metal foil being disposed adjacent said first electrode and at least partly intermediate said first electrode and said metal foil being disposed adjacent a portion of said wall of said vessel enclosed by planes disposed in normal relationship to the axis of said first electrode of the axial extremities of said first electrode and also in the immediate proximity of the wall of said discharge vessel.

2. A high-pressure discharge lamp as claimed in claim 1 wherein said metal foil is spaced from the wall of the discharge vessel by an amount not more than 2 mm and wherein the discharge vessel contains mercury and an alkali metal halide.

* * * * *